US012188398B2

(12) United States Patent
Zhu et al.

(10) Patent No.: US 12,188,398 B2
(45) Date of Patent: Jan. 7, 2025

(54) THERMAL MANAGEMENT AND CONTROL METHOD AND DEVICE, STORAGE MEDIUM, AND VEHICLE

(71) Applicant: BYD COMPANY LIMITED, Guangdong (CN)

(72) Inventors: Futang Zhu, Shenzhen (CN); Chunsheng Wang, Shenzhen (CN); Qiuping Huang, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 0 days.

(21) Appl. No.: 18/373,233

(22) Filed: Sep. 26, 2023

(65) Prior Publication Data

US 2024/0018894 A1 Jan. 18, 2024

Related U.S. Application Data

(63) Continuation of application No. PCT/CN2022/088511, filed on Apr. 22, 2022.

(30) Foreign Application Priority Data

Apr. 27, 2021 (CN) ..... 202110458536.8

(51) Int. Cl.
*F01P 7/16* (2006.01)
*F01P 5/02* (2006.01)
*F01P 5/10* (2006.01)

(52) U.S. Cl.
CPC ..... *F01P 7/165* (2013.01); *F01P 5/02* (2013.01); *F01P 5/10* (2013.01); *F01P 2025/13* (2013.01); *F01P 2025/64* (2013.01)

(58) Field of Classification Search
CPC ..... F01P 7/16; F01P 5/10; F01P 7/167; F01P 7/165; F01P 7/164; F01P 5/02;
(Continued)

(56) References Cited

U.S. PATENT DOCUMENTS 8,904,974 B2 * 12/2014 Pae ..... F04B 49/06 123/41.1
2004/0093149 A1 * 5/2004 Hara ..... B60H 1/00885 701/104
2015/0246591 A1 * 9/2015 Ono ..... B60W 10/08 180/65.265

FOREIGN PATENT DOCUMENTS

CN 110594004 A 12/2019
CN 111577441 A 8/2020
(Continued)

OTHER PUBLICATIONS

International Search Report and Written Opinion for Application No. PCT/CN2022/088511, mailed on Jun. 29, 2022, 10 pages.

*Primary Examiner* — George C Jin
*Assistant Examiner* — Teuta B Holbrook

(57) ABSTRACT

A thermal management and control method includes: determining a total target amount of to-be-dissipated heat of an engine based on a minimum engine fuel consumption lookup table when a current temperature of the engine is greater than or equal to a temperature threshold and an opening degree of the thermostat is greater than or equal to an opening degree threshold; querying a minimum thermal management system power consumption lookup table based on the total target amount of to-be-dissipated heat, an air inlet speed of an air-cooling radiator, and a current ambient temperature, and determining a target rotation speed of a water pump and a target rotation speed of the air-cooling radiator; and controlling a rotation speed of the water pump to be the target rotation speed of the water pump, and controlling a rotation speed of the air-cooling radiator to be the target rotation speed of the air-cooling radiator.

20 Claims, 4 Drawing Sheets

(58) Field of Classification Search
CPC ..... F01P 2025/13; F01P 2025/64; F01P 2025/66; F01P 2025/08; Y02T 10/12; F02D 2200/00; F02D 2200/021; F02D 41/30; F02D 41/2454
See application file for complete search history.

(56) References Cited

FOREIGN PATENT DOCUMENTS

| | | | |
|---|---|---|---|
| CN | 111828159 | A | 10/2020 |
| JP | 2011027012 | A | 2/2011 |

* cited by examiner

THERMAL MANAGEMENT AND CONTROL METHOD AND DEVICE, STORAGE MEDIUM, AND VEHICLE

CROSS-REFERENCE TO RELATED APPLICATIONS

This application is a Continuation Application of International Patent Application No. PCT/CN2022/088511, filed on Apr. 22, 2022, which is based on and claims priority to and benefits of Chinese Patent Application No. 202110458536.8, filed on Apr. 27, 2021. The entire content of all of the above-referenced applications is incorporated herein by reference.

FIELD

The present disclosure belongs to the field of vehicle technologies, and more particularly, to a thermal management and control method and device, a storage medium, and a vehicle.

BACKGROUND

A thermal management and control method for a vehicle engine in the related art adjusts an opening degree of a thermostat, a rotation speed of an electronic water pump, and a rotation speed of a radiator fan in an order of priority from high to low, to meet a heat dissipation requirement under various operating conditions. However, no consideration has been given to optimize both a thermal management system power consumption and an engine fuel consumption to optimize a vehicle energy consumption.

SUMMARY

In view of the above technical problems, a first aspect of the present disclosure provides a thermal management and control method for an engine. A rotation speed of a water pump and a rotation speed of an air-cooling radiator are controlled based on a preset minimum engine fuel consumption lookup table and a preset minimum thermal management system power consumption lookup table, to keep the engine at a temperature that implements minimum fuel consumption, the thermal management system implements minimum power consumption, and a vehicle implements optimal energy consumption.

A second aspect of the present disclosure provides a non-transitory computer-readable storage medium.

A third aspect of the present disclosure provides a thermal management and control device for a vehicle.

A fourth aspect of the present disclosure provides a vehicle.

An embodiment of a first aspect of the present disclosure provides a thermal management and control method for an engine. The engine is connected with a thermal management system. The thermal management system includes a water pump, an air-cooling radiator, and a thermostat. The engine is connected with the water pump. The air-cooling radiator is connected with the engine and the water pump through the thermostat. The thermal management and control method includes: querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine; querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator; and controlling a rotation speed of the water pump to be the target rotation speed of the water pump, and controlling a rotation speed of the air-cooling radiator to be the target rotation speed of the air-cooling radiator.

A temperature of the engine with the minimum fuel consumption or a maximum efficiency under a current operating condition is determined through a minimum engine fuel consumption lookup table, that is, a target temperature of the engine, and then the total target amount of to-be-dissipated heat required to reach the target temperature of the engine is determined. An optimal combination of the rotation speed of the water pump with a minimum power consumption and the rotation speed of the air-cooling radiator in a current environment is determined through the minimum thermal management system power consumption lookup table, that is, the target rotation speed of the water pump and the target rotation speed of the air-cooling radiator, so as to realize joint optimization of the engine fuel consumption and the thermal management system power consumption, and realize the optimal energy consumption of the vehicle.

An embodiment of a second aspect of the present disclosure provides a non-transitory computer-readable storage medium. The non-transitory computer-readable storage medium has a computer program stored thereon. The computer program is executed by a processor to implement the thermal management and control method according to the embodiment of the first aspect of the present disclosure.

An embodiment of a third aspect of the present disclosure provides a thermal management and control device for a vehicle. The device includes a processor and a memory. The processor and the memory are connected with each other. The memory is configured to store a computer program. The computer program includes program instructions. The processor is configured to execute the program instructions to perform the thermal management and control method according to the embodiment of the first aspect of the present disclosure.

An embodiment of a fourth aspect of the present disclosure provides a vehicle. The vehicle includes an engine and a thermal management system. The thermal management system includes a water pump, an air-cooling radiator, a thermostat, and the thermal management and control device according to the embodiment of the third aspect of the present disclosure. The engine is connected with the water pump to form a first cooling cycle. The air-cooling radiator is connected with the engine and the water pump through the thermostat to form a second cooling cycle.

At least some of the theoretical aspects and advantages of the present disclosure are to be given in the following description, and some will become apparent in the following description, or may be learned by practice of the present disclosure.

REFERENCE NUMERALS

100. Vehicle; 110. Engine; 120. Thermal management system; 121. Water pump; 122. Air-cooling radiator; 123. Thermostat; 124. Thermal management and control device; 124*a*. Processor; 124*b*. Memory.

DETAILED DESCRIPTION

The embodiments of the present disclosure are described below in detail. Examples of the embodiments are shown in the accompanying drawings, and same or similar reference signs in all the accompanying drawings indicate same or similar components or components having same or similar functions. The embodiments described below with reference to the accompanying drawings are examples, to explain the disclosure and should not be understood as a limitation on the disclosure.

A vehicle 100, a thermal management and control method and a thermal management and control device thereof, and a computer-readable storage medium (e.g., a non-transitory computer-readable storage medium) of embodiments of the present disclosure are described below with reference to FIG. 1 to FIG. 6.

Figure 1:
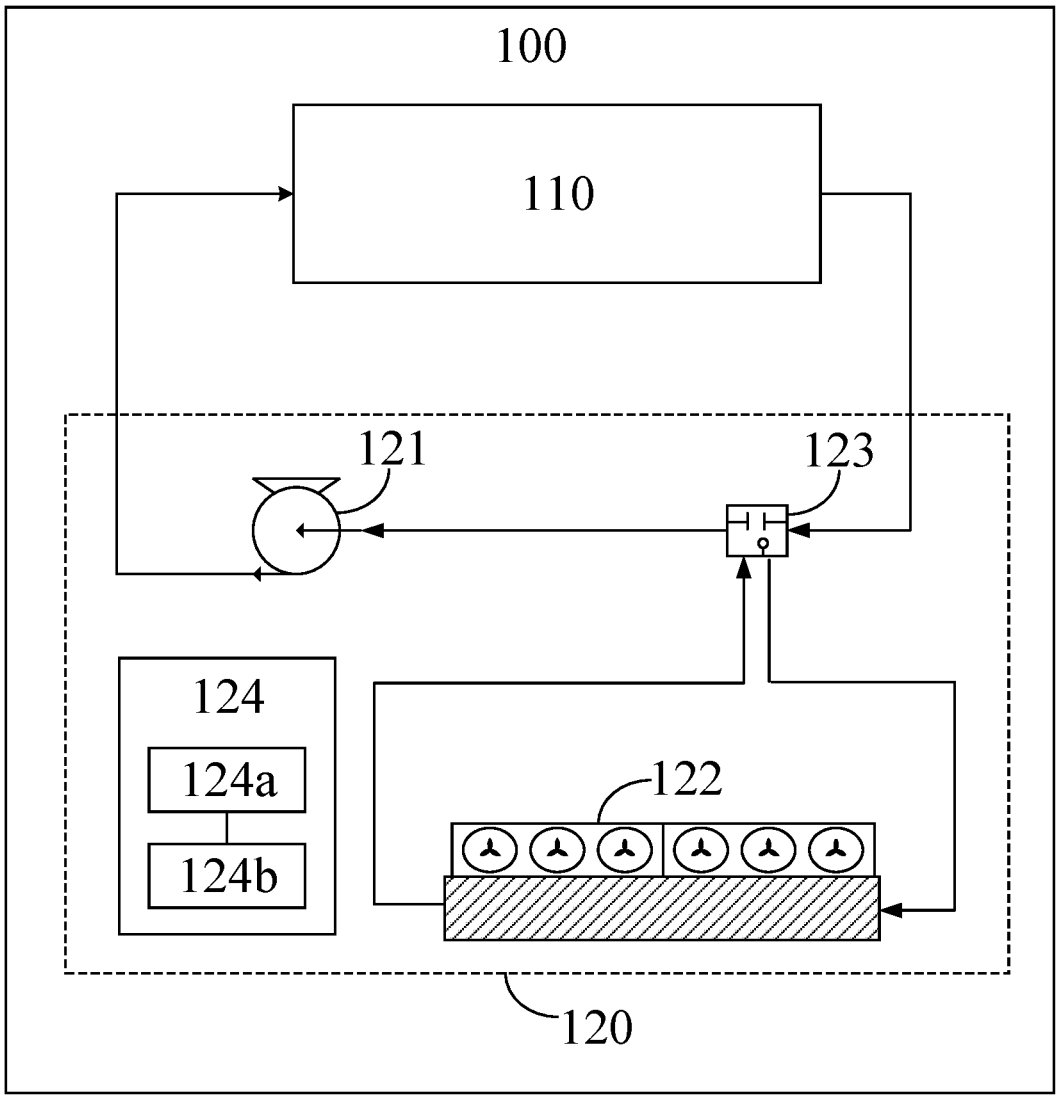
FIG. 1 is a schematic diagram of a vehicle according to an embodiment of the present disclosure.

As shown in FIG. 1, the vehicle 100 includes an engine 110 and a thermal management system 120. The thermal management system 120 includes a water pump 121, an air-cooling radiator 122, a thermostat 123, and a thermal management and control device 124. The thermal management and control device 124 includes a processor 124*a* and a memory 124*b*. The processor 124*a* and the memory 124*b* are connected to each other. The memory 124*b* is configured to store a computer program. The computer program includes program instructions. The processor 124*a* is configured to invoke the program instructions to perform the thermal management and control method provided by the embodiment. In addition, an embodiment of the present disclosure provides a computer-readable storage medium, having a computer program stored thereon. The computer program, when executed by the processor, implements the thermal management and control method provided by the embodiment of the present disclosure.

As shown in FIG. 1, the engine 110 is connected with the water pump 121 to form a first cooling cycle. That is to say, a coolant is pumped out by the water pump 121 through the engine 110 and cools the engine 110. The air-cooling radiator 122 is connected with the engine 110 and the water pump 121 through the thermostat 123 to form a second cooling cycle. That is to say, when the thermostat 123 is opened, the coolant is pumped out by the water pump 121 through the engine 110 and cools the engine 110, and then enters the air-cooling radiator 122 through passing thermostat 123 for cooling. It should be noted that the first cooling cycle is a small cycle for cooling the engine 110, and the second cooling cycle is a large cycle for cooling the engine 110.

Figure 2:
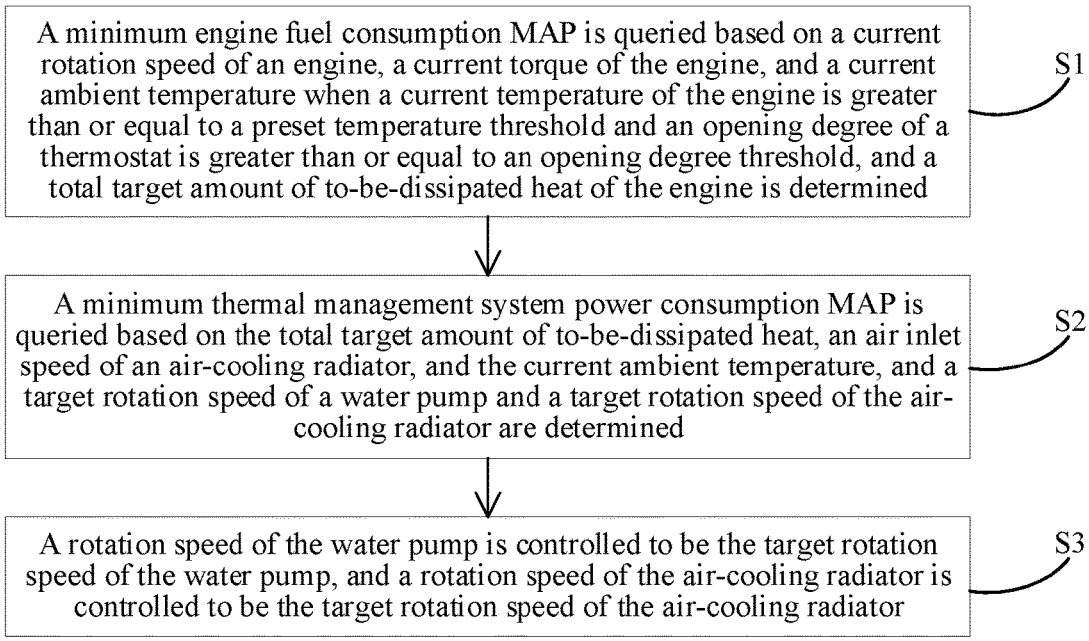
FIG. 2 is a schematic flowchart of a thermal management and control method according to an embodiment of the present disclosure.

As shown in FIG. 2, the thermal management and control method provided by this embodiment of the present disclosure includes the following steps S1 to S3.

S1: A minimum engine fuel consumption MAP (e.g., a lookup table) is queried based on a current rotation speed of an engine, a current torque of the engine, and a current ambient temperature when a current temperature of the engine is greater than or equal to a preset temperature threshold and an opening degree of a thermostat is greater than or equal to a preset opening degree threshold, and a total target amount of to-be-dissipated heat of the engine is determined. The minimum engine fuel consumption MAP (e.g., a lookup table) may include variables and their correlations for determining the minimum engine fuel consumption of the engine 110. The minimum engine fuel consumption MAP may include minimum engine fuel consumption of the engine, the current rotation speeds of the engine, and the current torques of the engine, the current ambient temperatures, the total target amounts of to-be-dissipated heat, and other parameters, and the correlations among them.

When the temperature of the engine 110 is greater than or equal to the preset temperature threshold, it can be considered that the engine 110 has completed a warm-up. In this case, the thermal management system 120 is required to continuously control the temperature of the engine 110. In some embodiments, the preset temperature threshold may be 60° C. to 80° C. In an embodiment, the preset temperature threshold is may be 80° C. It should be noted that a temperature-related parameter of the engine 110 in the present disclosure is a temperature when the coolant flows out of the engine 110. When the opening degree of the thermostat 123 is greater than or equal to the preset opening degree threshold, it can be considered that the engine 110 has entered an operating state having a high heat dissipation requirement. In some embodiments, the preset opening degree threshold is may be 95% to 100%. In an embodiment, the preset opening degree threshold is may be 100%, that is, the thermostat 123 is fully opened.

Therefore, when the engine 110 enters an operating state having the high heat dissipation requirement, both the water pump 121 and the air-cooling radiator 122 need to participate in the cooling of the engine 110, and cause the engine 110 to reach an operating state having the minimum fuel consumption, that is, the highest efficiency. In an embodiment, the current rotation speed of the engine, the current torque of the engine, and the current ambient temperature are used as input parameters to query the minimum engine fuel consumption MAP, and finally the total target amount of to-be-dissipated heat that enables the engine 110 to reach the operating state having the minimum fuel consumption, that is, the highest efficiency is outputted. The minimum engine fuel consumption MAP is calibrated through simulation and experiments in a research and development and design stage according to a condition of the vehicle 100, so that the engine 110 has the minimum fuel consumption and is preset in the thermal management and control device 124. The current ambient temperature refers to an air temperature outside the vehicle, that is, an intake air temperature of the engine 110 and an air inlet temperature of the air-cooling radiator 122.

S2: A minimum thermal management system power consumption MAP is queried based on the total target amount of to-be-dissipated heat, an air inlet speed of the air-cooling radiator, and the current ambient temperature, and a target rotation speed of the water pump and a target rotation speed of the air-cooling radiator are determined. The minimum thermal management system power consumption MAP/lookup table may include variables and their correlations for determining the minimum power consumption for the thermal management system. The minimum thermal management system power consumption MAP may include minimum thermal management system power consumption, the total target amounts of to-be-dissipated heat, the air inlet speeds of the air-cooling radiator, the current ambient temperatures, the target rotation speeds of the water pump, the target rotation speeds of the air-cooling radiator, the current ambient temperatures, and other parameters, and the correlations among them for determining the minimum power consumption of the thermal management system 120.

When the opening degree of the thermostat 123 is greater than or equal to the preset opening degree threshold, the engine 110 is cooled by the second cooling cycle. The combinations of the rotation speeds of the water pump 121 and the air-cooling radiator 122 that enable the engine 110 to reach the operating state having the minimum fuel consumption, that is, the highest efficiency, may be unlimited. While in embodiments of the present disclosure, the total target amount of to-be-dissipated heat, the air inlet speed of the air-cooling radiator 122, and the current ambient temperature are used as the input parameters to query the minimum thermal management system power consumption MAP, and output the optimal combination of the target rotation speed of the water pump and the target rotation speed of the air-cooling radiator, so that the thermal management system 120 operates at the minimum power consumption. The minimum thermal management system power consumption MAP is calibrated through simulation and experiments according to a condition of the thermal management system 120, under the condition that the thermal management system 120 has the minimum power consumption, and is preset in the thermal management and control device 124. In some embodiments, the air inlet speed of the air-cooling radiator 122 is determined based on a current vehicle speed and an ambient air speed.

S3: A rotation speed of the water pump is controlled to be the target rotation speed of the water pump, and a rotation speed of the air-cooling radiator is controlled to be the target rotation speed of the air-cooling radiator.

The total target amount of to-be-dissipated heat required by the engine to reach a state with the minimum fuel consumption or the highest efficiency under the current operating condition is determined through the preset minimum engine fuel consumption MAP. An optimal combination of the rotation speed of the water pump 121 with the minimum power consumption and the rotation speed of the air-cooling radiator 122 in the current environment is determined through the preset minimum thermal management system power consumption MAP, that is, the target rotation speed of the water pump and the target rotation speed of the air-cooling radiator. The water pump 121 and the air-cooling radiator 122 are respectively controlled to operate at the target rotation speed of the water pump and the target rotation speed of the air-cooling radiator, so as to realize joint optimization of the engine fuel consumption and the thermal management system power consumption, and realize the optimal energy consumption of the vehicle. It should be noted that the rotation speed of the air-cooling radiator 122 refers to a rotation speed of a fan in the air-cooling radiator 122.

In some embodiments, step S1 includes the following steps S110 to S130.

S110: The minimum engine fuel consumption MAP is queried based on the current rotation speed of the engine, the current torque of the engine, and the current ambient temperature, and a target temperature of the engine is determined.

S120: A heat amount of the engine is determined based on the current rotation speed of the engine and the current torque of the engine.

S130: A total target amount of to-be-dissipated heat is determined based on the current temperature of the engine, the target temperature of the engine, and the heat amount of the engine.

The current rotation speed of the engine, the current torque of the engine, and the current ambient temperature are used as input parameters to query the minimum engine fuel consumption MAP, and the target temperature of the engine that enables the engine 110 to reach the operating state having the minimum fuel consumption, that is, the highest efficiency, is outputted. In some embodiments, based on a difference $\Delta T$ between the current temperature of the engine and the target temperature of the engine, it can be calculated that the heat amount required by the engine from the current temperature to the target temperature is $C \cdot M \cdot \Delta T$, where C is a heat capacity of a coolant, M is a mass of the coolant, and the mass of the coolant is related to the flow rate. Therefore, the total target amount of to-be-dissipated heat of engine cooling can be obtained by differentiating the heat amount of the engine from $C \cdot M \cdot \Delta T$.

Figure 3:
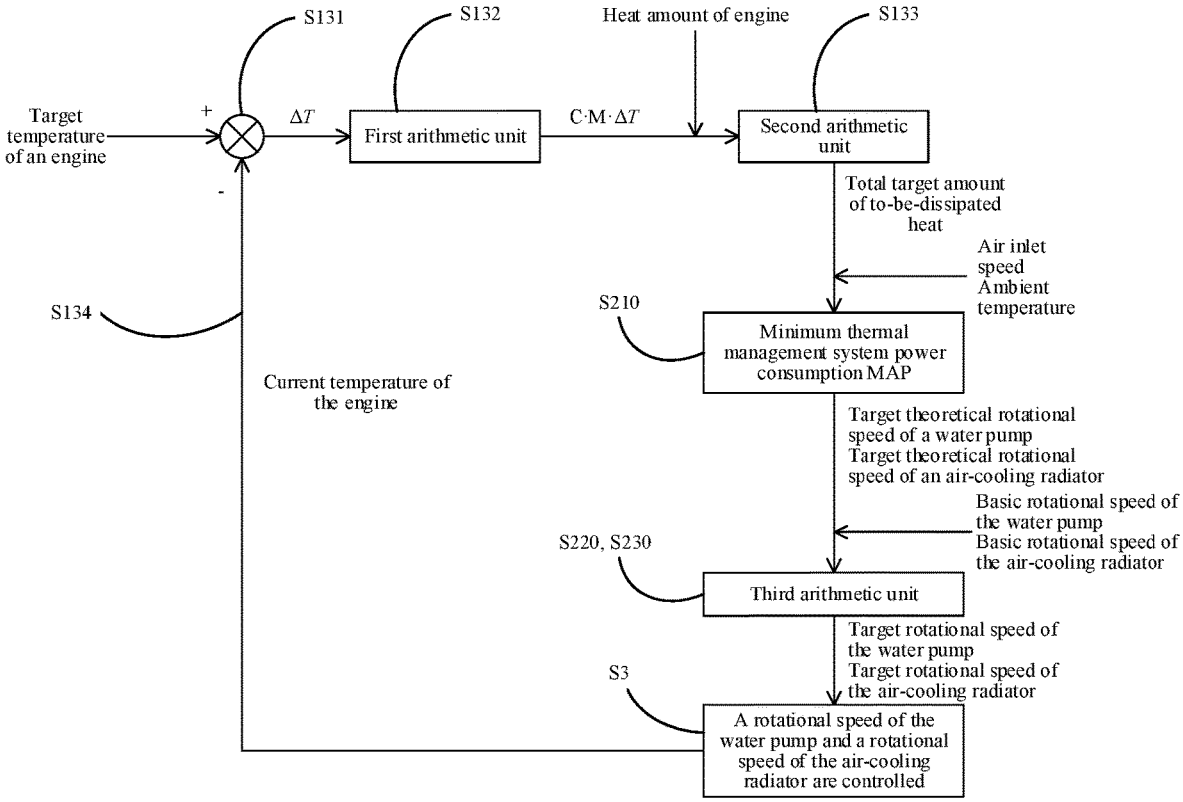
FIG. 3 is a schematic flowchart of a first feedback control of a thermal management and control method according to an embodiment of the present disclosure.

As shown in FIG. 3, in some embodiments, step S130 includes: determining, by a first feedback control in a closed-loop manner, a total target amount of to-be-dissipated heat, where the target temperature of the engine and the heat amount of the engine are inputs of the first feedback control; the current temperature of the engine is a feedback variable of the first feedback control; and the total target amount of to-be-dissipated heat is an output of the first feedback control. By controlling the total target amount of to-be-dissipated heat in a closed loop through the feedback control, the engine can be continuously and stably operated at a temperature with the minimum fuel consumption and the highest efficiency. In some embodiments, step S130 includes the following steps.

S131: The target temperature of the engine is used as an input, and the current temperature of the engine is used as a feedback variable to input a first adder, and is outputted to obtain a target temperature difference $\Delta T$.

S132: The target temperature difference $\Delta T$ is inputted into a first arithmetic unit, and is outputted to obtain the heat amount $C \cdot M \cdot \Delta T$ required by the engine.

S133: The heat amount $C \cdot M \cdot \Delta T$ required by the engine and the heat output of the engine are inputted into a second arithmetic unit, and is outputted to obtain the total target amount of to-be-dissipated heat.

S134: After S2 and S3, the current temperature of the engine is re-obtained and inputted to the first adder as the feedback variable.

As shown in FIG. 3, in some embodiments, step S2 includes the following steps.

S210: A minimum thermal management system power consumption MAP is queried based on the total target amount of to-be-dissipated heat, an air inlet speed of the air-cooling radiator, and the current ambient temperature, and a target theoretical rotation speed of the water pump and a target theoretical rotation speed of the air-cooling radiator are determined.

S220: The target rotation speed of the water pump is determined based on a base rotation speed of the water pump and the target theoretical rotation speed of the water pump. In some embodiments, the target rotation speed of the water pump is outputted by inputting the base rotation speed of the water pump and the target theoretical rotation speed of the water pump into a third arithmetic unit.

S230: The target rotation speed of the air-cooling radiator is determined based on a base rotation speed of the air-cooling radiator and the target theoretical rotation speed of the air-cooling radiator. In some embodiments, the target rotation speed of the air-cooling radiator is outputted by inputting the base rotation speed of the air-cooling radiator and the target theoretical rotation speed of the air-cooling radiator into the third arithmetic unit.

In order to avoid large fluctuations in the total target amount of to-be-dissipated heat outputted by the first feedback control and the current temperature of the engine fed back, the water pump 121 and the air-cooling radiator 122 are required to ensure a certain rotation speed, that is, the base rotation speed of the water pump and the base rotation speed of the air-cooling radiator.

In some embodiments, a stable water pump rotation speed MAP is queried based on the current rotation speed of the engine, the current torque of the engine, and the current ambient temperature, and the base rotation speed of the water pump is determined. The stable water pump rotation speed MAP/lookup table may include variables and their correlations for determining the stable rotation speed for the water pump. The stable water pump rotation speed MAP/lookup table may include stable water pump rotation speeds, the current rotation speeds of the engine, the current torques of the engine, the current ambient temperatures, the base rotation speeds of the water pump, and other parameters, and the correlations among them for determining the stable water pump rotation speed. A stable air-cooling radiator rotation speed MAP is queried based on the current rotation speed of the engine, the current torque of the engine, the air inlet speed of the air-cooling radiator, and the current ambient temperature, and the base rotation speed of the air-cooling radiator is determined. The stable air-cooling radiator rotation speed MAP/lookup table may include variables and their correlations for determining the stable rotation speed for the air-cooling radiator. The stable air-cooling radiator rotation speed MAP/lookup table may include stable air-cooling radiator rotation speeds, the current rotation speeds of the engine, the current torques of the engine, the air inlet speeds of the air-cooling radiator, the current ambient temperatures, the base rotation speeds of the air-cooling radiator, and other parameters, and the correlations among them for determining the stable air-cooling radiator rotation speed. That is to say, the current rotation speed of the engine, the current torque of the engine, and the current ambient temperature are used as input parameters to query the stable water pump rotation speed MAP, and output the base rotation speed of the water pump. The current rotation speed of the engine, the current torque of the engine, the air inlet speed of the air-cooling radiator 122, and the current ambient temperature are used as input parameters to query the stable air-cooling radiator rotation speed MAP, and determine the base rotation speed of the air-cooling radiator. It should be noted that the stable water pump rotation speed MAP and the stable air-cooling radiator rotation speed MAP are calibrated through simulation and experiments according to conditions of the engine 110 and the thermal management system 120, and are preset in the thermal management and control device 124.

In some implementations, step S220 includes: determining that the target rotation speed of the water pump is equal to a sum of the base rotation speed of the water pump and the target theoretical rotation speed of the water pump; or determining that the target rotation speed of the water pump is equal to a larger one of the base rotation speed of the water pump and the target theoretical rotation speed of the water pump. Step S230 includes: determining that the target rotation speed of the air-cooling radiator is equal to a sum of the base rotation speed of the air-cooling radiator and the target theoretical rotation speed of the air-cooling radiator; or determining that the target rotation speed of the air-cooling radiator is equal to a larger one of the base rotation speed of the air-cooling radiator and the target theoretical rotation speed of the air-cooling radiator. In different embodiments, it is necessary to ensure that the target rotation speed of the water pump is greater than or equal to the base rotation speed of the water pump. According to different calculation methods, the minimum thermal management system power consumption MAP is adjusted to meet the optimal combination of the rotation speeds of the water pump 121 and the air-cooling radiator 122 with the minimum power consumption.

Figure 4:
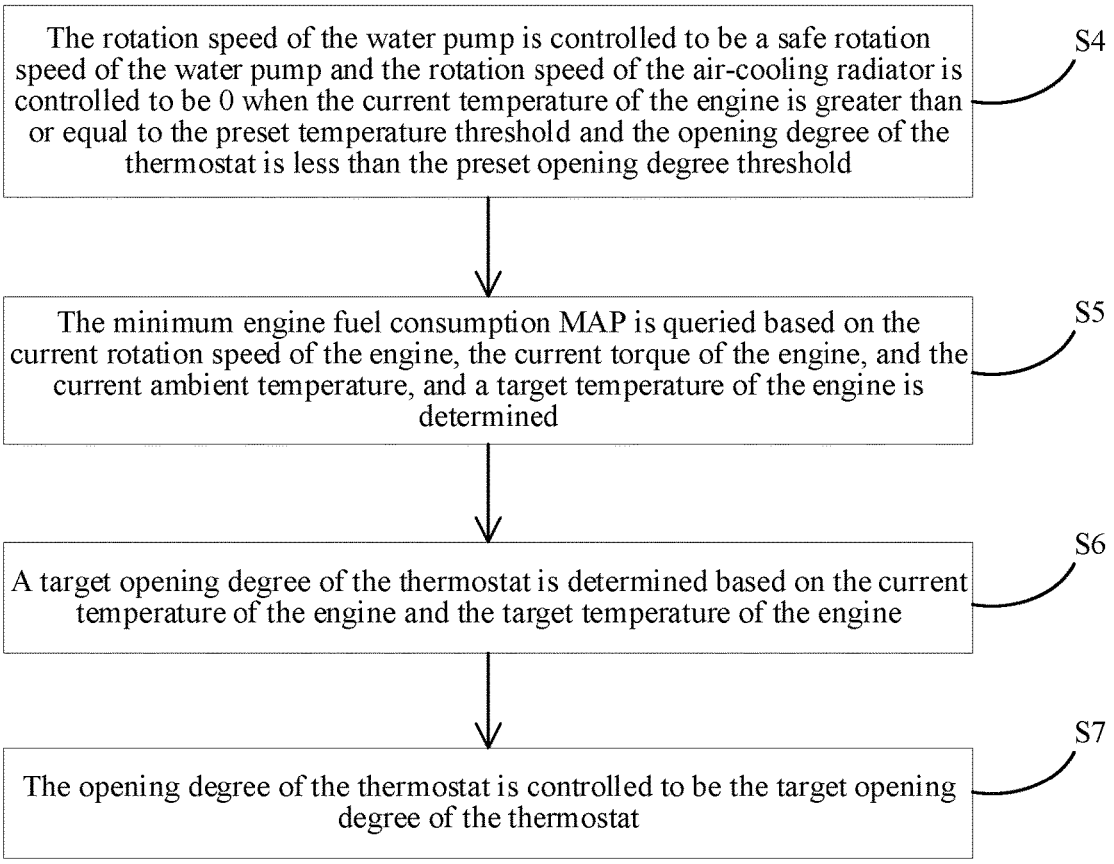
FIG. 4 is a schematic flowchart of a thermal management and control method according to an embodiment of the present disclosure.

As shown in FIG. 4, in some embodiments, the thermal management and control method provided by the present disclosure further includes steps S4 to S7.

S4: The rotation speed of the water pump is controlled to be a safe rotation speed of the water pump and the rotation speed of the air-cooling radiator is controlled to be 0 when the current temperature of the engine is greater than or equal to the preset temperature threshold and the opening degree of the thermostat is less than the preset opening degree threshold.

When an opening degree of the thermostat 123 is less than a preset opening degree threshold, it can be considered that the engine 110 has not entered a high temperature operating state. In this case, there is no need for the air-cooling radiator to actively dissipate heat in the second cooling cycle, and a natural air intake can be relied on. At the same time, the water pump operates at the minimum rotation speed to avoid local overheating of the engine 110, and the thermal management system 120 is in the rotation speed power consumption state in this case. It should be noted that a safe rotation speed of the water pump is a speed under a safe flow rate. The so-called safe flow refers to a minimum flow value that meets the cooling of a cylinder block and a cylinder cover of the engine under a certain load, that is, the flow rate that does not produce local overheating and boiling. In some embodiments, a safe water pump rotation speed is queried based on the current rotation speed of the engine and the current torque of the engine, and the safe rotation speed of the water pump is determined. The safe water pump rotation speed MAP is calibrated through simulation and experiments according to the condition of the engine 110 with the minimum cooling flow rate that does not cause local overheating of the engine 110, and is preset in the thermal management and control device 124.

S5: The minimum engine fuel consumption MAP is queried based on the current rotation speed of the engine, the current torque of the engine, and the current ambient temperature, and a target temperature of the engine is determined.

S6: A target opening degree of the thermostat is determined based on the current temperature of the engine and the target temperature of the engine.

S7: The opening degree of the thermostat is controlled to be the target opening degree of the thermostat.

When the temperature of the engine 110 is greater than or equal to the preset temperature threshold and the opening degree of the thermostat 123 is less than the preset opening degree threshold, it can be considered that the engine 110 has completed the warm-up, but the engine 110 has not entered the high temperature operating state. In this case, the opening degree of the thermostat 123 can be controlled, so that the engine 110 reaches the target temperature to operate at the minimum fuel consumption and the highest efficiency. Meanwhile, since the water pump 121 operates at the minimum rotation speed and the air-cooling radiator stops operating, the thermal management system 120 is also in the minimum power consumption state.

In some embodiments, step S6 includes: determining, by a second feedback control in a closed-loop manner, the target opening degree of the thermostat, where the target temperature of the engine is an input of the feedback control, the current temperature of the engine is a feedback variable of the second feedback control, and the target opening degree of the thermostat is an output of the feedback control. By controlling the target opening degree of the thermostat in a closed loop through the feedback control, the engine can be continuously and stably operated at a temperature with the minimum fuel consumption and the highest efficiency.

In some embodiments, step S6 further includes: determining a target theoretical opening degree of the thermostat based on the current temperature of the engine and the target temperature of the engine; and determining the target opening degree of the thermostat based on a base opening degree of the thermostat and the target theoretical opening degree of the thermostat. In order to avoid large fluctuations in the target opening degree of the thermostat outputted by the second feedback control and the current temperature of the engine fed back, the thermostat 123 is required to ensure a certain opening degree, that is, the base opening degree of the thermostat.

In some embodiments, a stable thermostat opening degree MAP is queried based on the current rotation speed of the engine and the current torque of the engine; and a base opening degree of the thermostat is determined. The stable thermostat opening degree MAP/lookup table may include variables and their correlations for determining the stable opening degree for the thermostat. The stable thermostat opening degree MAP/lookup table may include stable thermostat opening degrees, the current rotation speeds of the engine, the current torques of the engine, the base opening degrees of the thermostat, and other parameters, and the correlations among them for determining the stable thermostat opening degree. That is to say, the current rotation speed of the engine and the current torque of the engine are used as the input parameters to query the stable thermostat opening degree MAP, and output the base opening degree of the thermostat. It should be noted that the stable thermostat opening degree MAP is calibrated through simulation and experiments according to conditions of the engine 110 and the thermal management system 120, and are preset in the thermal management and control device 124.

In some embodiments, the determining the target opening degree of the thermostat based on a base opening degree of the thermostat and the target theoretical opening degree of the thermostat includes: determining that the target opening degree of the thermostat is equal to a sum of the base opening degree of the thermostat and the target theoretical opening degree of the thermostat, or determining that the target rotation speed of the thermostat is equal to a larger one of the base opening degree of the thermostat and the target theoretical opening degree of the thermostat. In various embodiments, it is necessary to ensure that the target opening degree of the thermostat is greater than or equal to the base opening degree of the thermostat. According to different calculation methods, the stable thermostat opening degree MAP is adjusted to satisfy the opening degree of the thermostat 123 with a smallest fluctuation of the second feedback control.

In some embodiments, the determining a target theoretical opening degree of the thermostat based on the current temperature of the engine and the target temperature of the engine includes: performing proportional-integral-differential processing, proportional-integral processing, or proportional-differential processing on a difference between the target temperature of the engine and the current temperature of the engine, to obtain the target theoretical opening degree of the thermostat. The proportional-integral-differential processing is proportion, integral, and differential (PID) adjustment. The proportional-integral processing is proportion and integral (PI) adjustment. The proportional-differential processing is proportion and differential (PD) adjustment. By selecting one of the PID adjustment or the PI adjustment or the PD adjustment, the output parameters include the target temperature of the engine and the current temperature of the engine, and the target theoretical opening degree of the thermostat is outputted. The PID adjustment or the PI adjustment or the PD adjustment can be used to effectively correct a deviation of the target opening degree of the thermostat, so that a stable state can be reached.

Figure 5:
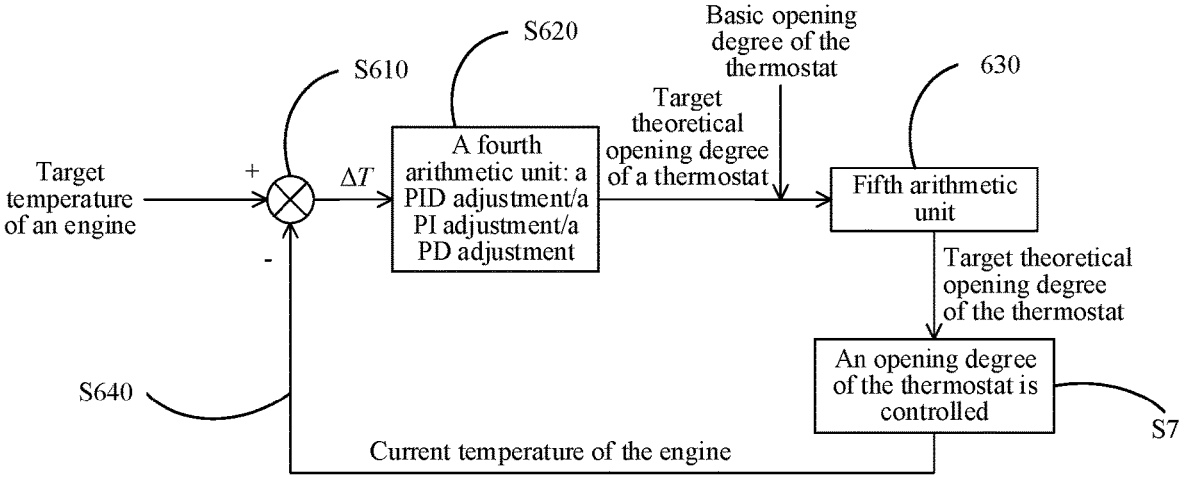
FIG. 5 is a schematic flowchart of a second feedback control of a thermal management and control method according to an embodiment of the present disclosure.

As shown in FIG. 5, in some embodiments, step S6 includes the following steps.

S610: The target temperature of the engine is used as an input, and the current temperature of the engine is used as a feedback variable to input a second adder, and is outputted to obtain a target temperature difference ΔT.

S620: The target temperature difference ΔT is outputted into a fourth arithmetic unit, and the PID adjustment or the PI adjustment or the PD adjustment is performed on the target temperature difference ΔT, and is outputted to obtain the target theoretical opening degree of the thermostat.

S630: The target theoretical opening degree of the thermostat and the base opening degree of the thermostat are outputted into a fifth arithmetic unit, and the target opening degree of the thermostat is outputted.

S640: After S7, the current temperature of the engine is re-obtained and inputted to the second adder as the feedback variable.

In in some embodiments, the thermal management and control method provided by the present disclosure further includes: controlling the rotation speed of the air-cooling radiator to be 0 and controlling the opening degree of the thermostat to be 0 when the current temperature of the engine is less than the preset temperature threshold. When the temperature of the engine 110 is less than the preset temperature threshold, it may be considered that the engine 110 is still in a warm-up state. Therefore, the thermostat 123 does not need to be opened, that is, the second cooling cycle is not required to participate in the cooling of the engine 110. As a result, the rotation speed of the air-cooling radiator is controlled to be 0, and the opening degree of the thermostat is controlled to be 0, so that the thermal management system 120 is in a state with the minimum power consumption.

Figure 6:
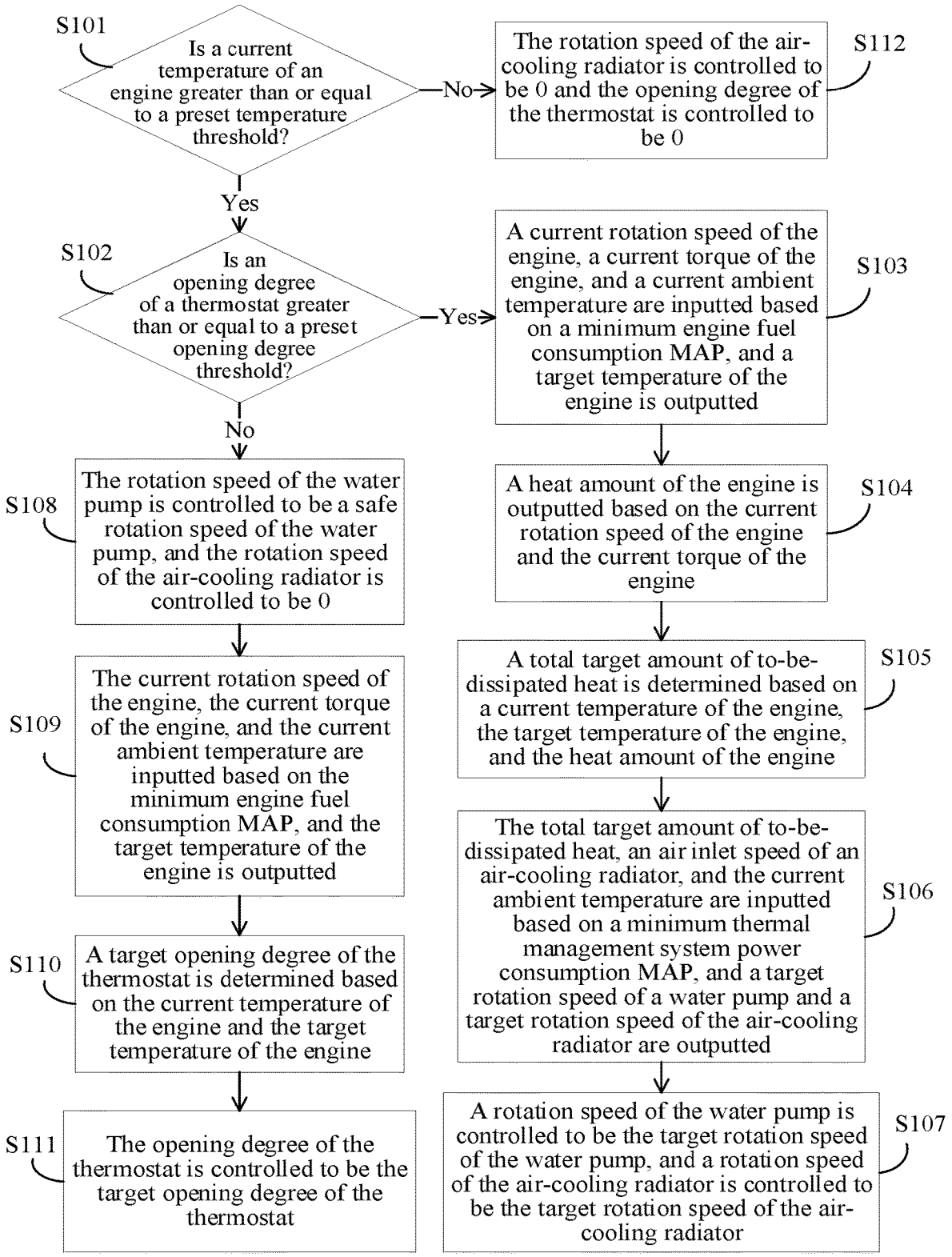
FIG. 6 is a schematic flowchart of a thermal management and control method according to an embodiment of the present disclosure.

As shown in FIG. 6, in some embodiments, the thermal management and control method provided by the present disclosure includes steps S101 to S112.

S101: It is determined whether the current temperature of an engine is greater than or equal to the preset temperature threshold. If so, S102 is performed, and if not, S112 is performed.

S102: It is determined whether an opening degree of a thermostat is greater than or equal to a preset opening degree threshold. If so, S103 is performed, and if not, S107 is performed.

S103: The minimum engine fuel consumption MAP is queried based on the current rotation speed of the engine, the current torque of the engine, and the current ambient temperature, and a target temperature of the engine is determined.

S104: A heat amount of the engine is outputted based on the current rotation speed of the engine and the current torque of the engine.

S105: A total target amount of to-be-dissipated heat is determined based on a current temperature of the engine, the target temperature of the engine, and the heat amount of the engine.

S106: A minimum thermal management system power consumption MAP is queried based on the total target amount of to-be-dissipated heat, an air inlet speed of the air-cooling radiator, and the current ambient temperature, and a target rotation speed of the water pump and a target rotation speed of the air-cooling radiator are determined.

S107: A rotation speed of the water pump is controlled to be the target rotation speed of the water pump, and a rotation speed of the air-cooling radiator is controlled to be the target rotation speed of the air-cooling radiator.

S108: The rotation speed of the water pump is controlled to be a safe rotation speed of the water pump, and the rotation speed of the air-cooling radiator is controlled to be 0.

S109: The minimum engine fuel consumption MAP is queried based on the current rotation speed of the engine, the current torque of the engine, and the current ambient temperature, and a target temperature of the engine is determined.

S110: A target opening degree of the thermostat is determined based on the current temperature of the engine and the target temperature of the engine.

S111: The opening degree of the thermostat is controlled to be the target opening degree of the thermostat.

S112: The rotation speed of the air-cooling radiator is controlled to be 0 and the opening degree of the thermostat is controlled to be 0.

A temperature of the engine with the minimum fuel consumption or the maximum efficiency under a current operating condition is determined through the preset minimum engine fuel consumption MAP, that is, a target temperature of the engine, and then the total target amount of to-be-dissipated heat required to reach the target temperature of the engine is determined. An optimal combination of the rotation speed of the water pump 121 with the minimum power consumption and the rotation speed of the air-cooling radiator 122 in the current environment is determined through the preset minimum thermal management system power consumption MAP, that is, the target rotation speed of the water pump and the target rotation speed of the air-cooling radiator. The water pump 121 and the air-cooling radiator 122 are respectively controlled to operate at the target rotation speed of the water pump and the target rotation speed of the air-cooling radiator, so as to realize joint optimization of the engine fuel consumption and the thermal management system power consumption, and realize the optimal energy consumption of the vehicle.

In the description of this specification, the description of the reference terms "an embodiment", "some embodiments", "an example", "a specific example", "some examples," and the like means that features, structures, materials, or characteristics described in combination with the embodiment(s) or example(s) are included in at least one embodiment or example of the present disclosure. In this specification, schematic descriptions of the foregoing terms are not necessarily directed at the same embodiment or example. Besides, the features, the structures, the materials, or the characteristics that are described may be combined in proper manners in any one or more embodiments or examples. In addition, a person skilled in the art may integrate or combine different embodiments or examples described in the specification and features of the different embodiments or examples in a case without conflict.

In addition, terms "first" and "second" are used merely for the purpose of description, and shall not be understood as indicating or implying relative importance or implying a quantity of indicated technical features. Therefore, a feature restricted by "first" or "second" may explicitly indicate or implicitly include at least one of such features. In the descriptions of the present disclosure, unless explicitly specified, "multiple" means at least two, for example, two or three.

A description of any process or method in the flowcharts or described herein in another manner can be understood as representing one or more modules, fragments, or parts that include code of executable instructions used to implement a logical function or steps of a process. In addition, the scope of the implementations of the present disclosure includes another implementation, where functions can be performed not in an order shown or discussed, including performing the functions at the same time or in reverse order according to the functions involved. This should be understood by a person skilled in the technical field to which the embodiments of the present disclosure belong.

The logic and/or steps shown in the flowcharts or described in any other manner herein, for example, a sequenced list that may be considered as executable instructions used for implementing logical functions, may be implemented in any computer-readable storage medium to be used by an instruction execution system, apparatus, or device (for example, a computer-based system, a system including a processor, or another system that can obtain an instruction from the instruction execution system, apparatus, or device and execute the instruction) or to be used by combining such instruction execution systems, apparatuses, or devices. In the specification of this application, the "computer-readable storage medium" may be any apparatus that can include, store, communicate, propagate, or transmit programs to be used by the instruction execution system, apparatus, or device or to be used in combination with the instruction execution system, apparatus, or device. More examples (a non-exhaustive list) of the computer-readable storage medium include: an electrical connection portion (electronic device) with one or more wires, a portable computer case (magnetic device), a random access memory (RAM), a read-only memory (ROM), an erasable and editable read-only memory (EPROM or flash memory), an optical fiber device, and a portable compact disk read only memory (CDROM). In addition, the computer-readable storage medium can even be paper or other suitable media on which the program can be printed, because the program can be obtained electronically by, for example, optically scanning paper or other media, then editing, interpreting, or processing in other suitable ways if necessary, and then storing it in a computer memory.

It should be understood that, parts of the present disclosure can be implemented by using hardware, software, firmware, or a combination thereof. In the foregoing implementations, a plurality of steps or methods may be implemented by using software or firmware that are stored in a memory and are executed by a proper instruction execution system. For example, if hardware is used for implementation, same as in another implementation, implementation may be performed by any one of the following technologies well known in the art or a combination thereof: A discrete logic circuit including a logic gate circuit for implementing a logic function of a data signal, a dedicated integrated circuit including a proper combined logic gate circuit, a programmable gate array (PGA), a field programmable gate array (FPGA), and the like.

A person of ordinary skill in the art may understand that all or some of the steps of the methods in the foregoing embodiments may be implemented by a program instructing relevant hardware. The program may be stored in a computer-readable storage medium. When the program is executed, one or a combination of the steps of the method embodiments are performed.

In addition, each functional unit in each embodiment of the present disclosure may be integrated into one processing module, or each unit may exist alone physically, or two or more units may be integrated into one module. The integrated module may be implemented in the form of hardware, or may be implemented in a form of a software functional module. If implemented in the form of software functional modules and sold or used as an independent product, the integrated module may also be stored in a computer-readable storage medium.

The storage medium mentioned above may be a read-only memory, a magnetic disk, an optical disc, or the like. Although the embodiments of the present disclosure have been shown and described above, it can be understood that, the foregoing embodiments are examples and should not be understood as limitation to the present disclosure. A person of ordinary skill in the art can make changes, modifications, replacements, or variations to the foregoing embodiments within the scope of the present disclosure.

What is claimed is:

1. A thermal management and control method for an engine, wherein the engine is connected with a thermal management system, the thermal management system comprises a water pump, an air-cooling radiator, and a thermostat, and the engine is connected with the water pump; and the air-cooling radiator is connected with the engine and the water pump through the thermostat, the thermal management and control method comprising:

querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine;

querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator; and controlling a rotation speed of the water pump to be the target rotation speed of the water pump, and controlling a rotation speed of the air-cooling radiator to be the target rotation speed of the air-cooling radiator.

2. The thermal management and control method according to claim 1, wherein the querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine comprise:

querying the minimum engine fuel consumption lookup table based on the current rotation speed of the engine, the current torque of the engine, and the current ambient temperature, and determining a target temperature of the engine;

determining a heat amount of the engine based on the current rotation speed of the engine and the current torque of the engine; and determining the total target amount of to-be-dissipated heat based on the current temperature of the engine, the target temperature of the engine, and the heat amount of the engine.

3. The thermal management and control method according to claim 2, wherein the determining the total target amount of to-be-dissipated heat based on the current temperature of the engine, the target temperature of the engine, and the heat amount of the engine comprises:

determining, by a first feedback control, the total target amount of to-be-dissipated heat, wherein the target temperature of the engine and the heat amount of the engine are inputs of the first feedback control; the current temperature of the engine is a feedback variable of the first feedback control; and the total target amount of to-be-dissipated heat is an output of the first feedback control.

4. The thermal management and control method according to claim 1, wherein the querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator comprise:

querying the minimum thermal management system power consumption lookup table based on the total target amount of to-be-dissipated heat, an air inlet speed of the air-cooling radiator, and the current ambient temperature, and determining a target theoretical rotation speed of the water pump and a target theoretical rotation speed of the air-cooling radiator;

determining the target rotation speed of the water pump based on a base rotation speed of the water pump and the target theoretical rotation speed of the water pump; and determining the target rotation speed of the air-cooling radiator based on a base rotation speed of the air-cooling radiator and the target theoretical rotation speed of the air-cooling radiator.

5. The thermal management and control method according to claim 4, wherein the determining the target rotation speed of the water pump based on a base rotation speed of the water pump and the target theoretical rotation speed of the water pump comprises: determining that the target rotation speed of the water pump is a sum of the base rotation speed of the water pump and the target theoretical rotation speed of the water pump; or determining that the target rotation speed of the water pump is a greater one of the base rotation speed of the water pump and the target theoretical rotation speed of the water pump; and the determining the target rotation speed of the air-cooling radiator based on a base rotation speed of the air-cooling radiator and the target theoretical rotation speed of the air-cooling radiator comprises: determining that the target rotation speed of the air-cooling radiator is a sum of the base rotation speed of the air-cooling radiator and the target theoretical rotation speed of the air-cooling radiator; or determining that the target rotation speed of the air-cooling radiator is a greater one of the base rotation speed of the air-cooling radiator and the target theoretical rotation speed of the air-cooling radiator.

6. The thermal management and control method according to claim 4, wherein the determining the target rotation speed of the water pump based on a base rotation speed of the water pump and the target theoretical rotation speed of the water pump comprises: querying a stable water pump rotation speed lookup table based on the current rotation speed of the engine, the current torque of the engine, and the current ambient temperature, and determining the base rotation speed of the water pump; and the determining the target rotation speed of the air-cooling radiator based on a base rotation speed of the air-cooling radiator and the target theoretical rotation speed of the air-cooling radiator comprises: querying a stable air-cooling radiator rotation speed lookup table based on the current rotation speed of the engine, the current torque of the engine, the air inlet speed of the air-cooling radiator, and the current ambient temperature, and determining the base rotation speed of the air-cooling radiator.

7. The thermal management and control method according to claim 1, wherein the querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator comprise:

determining the air inlet speed of the air-cooling radiator based on a current vehicle speed and an ambient air speed.

8. The thermal management and control method according to claim 1, further comprising:

controlling the rotation speed of the water pump to be a safe rotation speed of the water pump and controlling the rotation speed of the air-cooling radiator to be zero when the current temperature of the engine is greater than or equal to the temperature threshold and the opening degree of the thermostat is less than the opening degree threshold;

querying the minimum engine fuel consumption lookup table based on the current rotation speed of the engine, the current torque of the engine, and the current ambient temperature, and determining a target temperature of the engine;

determining a target opening degree of the thermostat based on the current temperature of the engine and the target temperature of the engine; and controlling the opening degree of the thermostat to be the target opening degree of the thermostat.

9. The thermal management and control method according to claim 8, wherein the determining a target opening degree of the thermostat based on the current temperature of the engine and the target temperature of the engine comprises:

determining, by a second feedback control, the target opening degree of the thermostat, wherein the target temperature of the engine is an input of the second feedback control; the current temperature of the engine is a feedback variable of the second feedback control; and the target opening degree of the thermostat is an output of the second feedback control.

10. The thermal management and control method according to claim 9, wherein the determining a target opening degree of the thermostat based on the current temperature of the engine and the target temperature of the engine further comprises:

determining a target theoretical opening degree of the thermostat based on the current temperature of the engine and the target temperature of the engine; and determining the target opening degree of the thermostat based on a base opening degree of the thermostat and the target theoretical opening degree of the thermostat.

11. The thermal management and control method according to claim 10, wherein the determining the target opening degree of the thermostat based on a base opening degree of the thermostat and the target theoretical opening degree of the thermostat comprises:

determining that the target opening degree of the thermostat is a sum of the base opening degree of the thermostat and the target theoretical opening degree of the thermostat, or determining that the target rotation speed of the water pump is a greater one of the base opening degree of the thermostat and the target theoretical opening degree of the thermostat.

12. The thermal management and control method according to claim 10, wherein a stable thermostat opening degree lookup table is queried based on the current rotation speed of the engine and the current torque of the engine; and a base opening degree of the thermostat is determined.

13. The thermal management and control method according to claim 10, wherein the determining a target theoretical opening degree of the thermostat based on the current temperature of the engine and the target temperature of the engine comprises:

performing proportional-integral-differential processing, proportional-integral processing, or proportional-differential processing on a difference between the target temperature of the engine and the current temperature of the engine, to obtain the target theoretical opening degree of the thermostat.

14. The thermal management and control method according to claim 1, further comprising:

controlling the rotation speed of the air-cooling radiator to be zero and controlling the opening degree of the thermostat to be zero when the current temperature of the engine is less than the temperature threshold.

15. A non-transitory computer-readable storage medium, storing a computer program, the computer program being executed by a processor to cause the processor to perform operations of a thermal management system of an engine, wherein the thermal management system comprises a water pump, an air-cooling radiator, and a thermostat, and the engine is connected with the water pump; and the air-cooling radiator is connected with the engine and the water pump through the thermostat, the operations comprise:

querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine;

querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator; and controlling a rotation speed of the water pump to be the target rotation speed of the water pump, and controlling a rotation speed of the air-cooling radiator to be the target rotation speed of the air-cooling radiator.

16. A thermal management and control device for a vehicle, comprising a processor and a memory connected to the processor;

the memory being configured to store a computer program, the computer program comprising program instructions, and the processor being configured to execute the program instructions to perform operations of a thermal management system of an engine, wherein the thermal management system comprises a water pump, an air-cooling radiator, and a thermostat, and the engine is connected with the water pump; and the air-cooling radiator is connected with the engine and the water pump through the thermostat; and the operations comprise:

querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine;

querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator; and controlling a rotation speed of the water pump to be the target rotation speed of the water pump, and controlling a rotation speed of the air-cooling radiator to be the target rotation speed of the air-cooling radiator.

17. The device according to claim 16, wherein the querying a minimum engine fuel consumption lookup table based on a current rotation speed of the engine, a current torque of the engine, and a current ambient temperature when a current temperature of the engine is greater than or equal to a temperature threshold and an opening degree of the thermostat is greater than or equal to an opening degree threshold, and determining a total target amount of to-be-dissipated heat of the engine comprise:

querying the minimum engine fuel consumption lookup table based on the current rotation speed of the engine, the current torque of the engine, and the current ambient temperature, and determining a target temperature of the engine;

determining a heat amount of the engine based on the current rotation speed of the engine and the current torque of the engine; and determining the total target amount of to-be-dissipated heat based on the current temperature of the engine, the target temperature of the engine, and the heat amount of the engine.

18. The device according to claim 16, wherein the querying a minimum thermal management system power consumption lookup table based on the total target amount of to-be-dissipated heat, an air inlet speed of the air-cooling radiator, and the current ambient temperature, and determining a target rotation speed of the water pump and a target rotation speed of the air-cooling radiator comprise:

determining the air inlet speed of the air-cooling radiator based on a current vehicle speed and an ambient air speed.

19. The device according to claim 16, wherein the operations further comprise:

controlling the rotation speed of the air-cooling radiator to be zero and controlling the opening degree of the thermostat to be zero when the current temperature of the engine is less than the temperature threshold.

20. A vehicle, comprising an engine and a thermal management system, the thermal management system comprising a water pump, an air-cooling radiator, a thermostat, and the thermal management and control device according to claim 16.

* * * * *